US008911068B2

(12) United States Patent
Jo

(10) Patent No.: US 8,911,068 B2
(45) Date of Patent: Dec. 16, 2014

(54) INK CARTRIDGE AND IMAGE FORMING APPARATUS

(71) Applicant: Honriku Jo, Kanagawa (JP)

(72) Inventor: Honriku Jo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/892,577

(22) Filed: May 13, 2013

(65) Prior Publication Data

US 2013/0335481 A1 Dec. 19, 2013

(30) Foreign Application Priority Data

Jun. 18, 2012 (JP) ..... 2012-137156

(51) Int. Cl.
*B41J 2/175* (2006.01)
*B41J 2/165* (2006.01)

(52) U.S. Cl.
CPC ..... *B41J 2/17503* (2013.01)
USPC ..... 347/86; 347/36

(58) Field of Classification Search
CPC ..... B41J 2/17513; B41J 2/175; B41J 2002/17516; B41J 2/17556; B41J 2/16523
USPC ..... 347/36, 84–86
See application file for complete search history.

(56) References Cited

U.S. PATENT DOCUMENTS

| | | | | |
|---|---|---|---|---|
| 6,783,218 | B2 * | 8/2004 | Cheok | 347/86 |
| 7,416,293 | B2 * | 8/2008 | Langford et al. | 347/89 |
| 2012/0056932 | A1 | 3/2012 | Matsubara et al. | |
| 2012/0133707 | A1 | 5/2012 | Kikkawa et al. | |
| 2012/0162315 | A1 | 6/2012 | Takano et al. | |
| 2012/0306963 | A1 | 12/2012 | Jo | |
| 2012/0320125 | A1 | 12/2012 | Katoh et al. | |

FOREIGN PATENT DOCUMENTS

| | | |
|---|---|---|
| JP | 2002-307705 | 10/2002 |
| JP | 2002-307720 | 10/2002 |
| JP | 2002-361899 | 12/2002 |
| JP | 2004-148781 | 5/2004 |
| JP | 2010-064343 | 3/2010 |

OTHER PUBLICATIONS

U.S. Appl. No. 13/654,597, filed Oct. 18, 2012.

* cited by examiner

*Primary Examiner* — An Do

(74) *Attorney, Agent, or Firm* — Cooper & Dunham LLP

(57) ABSTRACT

An image forming apparatus includes an image forming device to form an image and an ink cartridge that includes a deformable ink supply bag having an ink supply port; a deformable waste ink collection bag having a fluid gateway; and a cartridge housing to accommodate the deformable ink supply bag and the deformable waste ink collection bag at the same time. A connecting member having a non-return valve is provided to connect the deformable ink supply bag and the deformable waste ink collection bag with each other at a section other than the ink supply port and the fluid gateway. The non-return valve prevents ink from flowing from the waste ink collection bag into the ink supply bag. A non-return valve control mechanism is provided not to operate the non-return valve in an initial state in which the ink supply bag is initially filled with ink.

16 Claims, 5 Drawing Sheets

INK CARTRIDGE AND IMAGE FORMING APPARATUS

CROSS-REFERENCE TO RELATED APPLICATION

This patent application is based on and claims priority pursuant to 35 U.S.C. §119 to Japanese Patent Application No. 2012-137156, filed on Jun. 18, 2012 in the Japan Patent Office, the entire disclosure of which is hereby incorporated by reference herein.

BACKGROUND OF THE INVENTION

1. Technical Field

This invention relates to an ink cartridge and an image forming apparatus employing the ink cartridge.

2. Description of the Related Art

An image forming apparatus, such as an ink jet printer, etc., forms an image with ink and is sometimes provided with an ink supply bag to store the ink and a waste ink collection bag to collect ink waste. In such an image forming apparatus, it is known that the ink supply bag and the waste ink collection bag are installed in a common ink cartridge to effectively downsize the ink cartridge and the image forming apparatus as described in Japanese Patent Application Publication Nos. 2002-307705 (JP-2002-307705-A) and 2002-307720 (JP-2002-307720-A). With such a configuration, the ink cartridge of each of JP-2002-307705-A and JP-2002-307720-A also simplifies disassembly and replacement of the ink cartridge.

However, when these are to be recycled, the ink supply bag and the waste ink collection bag need to be taken apart and cleaned thereafter, which is time-consuming as a problem.

SUMMARY OF THE INVENTION

Accordingly, the present invention provides a novel ink cartridge that includes a deformable ink supply bag (an ink bag in the drawings) having an ink supply port, a deformable waste ink collection bag (a liquid waste ink bag in the drawings) having a fluid gateway, and a cartridge housing to accommodate the deformable ink supply bag and the deformable waste ink collection bag at the same time. A connecting member has a non-return valve and is provided to connect the deformable ink supply bag and the deformable waste ink collection bag with each other at a section other than the ink supply port and the fluid gateway. The non-return valve prevents ink from flowing from the waste ink collection bag into the ink supply bag.

In yet another aspect of the present invention, an image forming apparatus employs an image forming device to form an image and an ink cartridge that includes a deformable ink supply bag having an ink supply port, a deformable waste ink collection bag having a fluid gateway, and a cartridge housing to accommodate the deformable ink supply bag and the deformable waste ink collection bag at the same time. A connecting member has a non-return valve and is provided to connect the deformable ink supply bag and the deformable waste ink collection bag with each other at a section other than the ink supply port and the fluid gateway. The non-return valve prevents ink from flowing from the waste ink collection bag into the ink supply bag.

BRIEF DESCRIPTION OF THE SEVERAL VIEWS OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION OF THE INVENTION

Figure 1A:
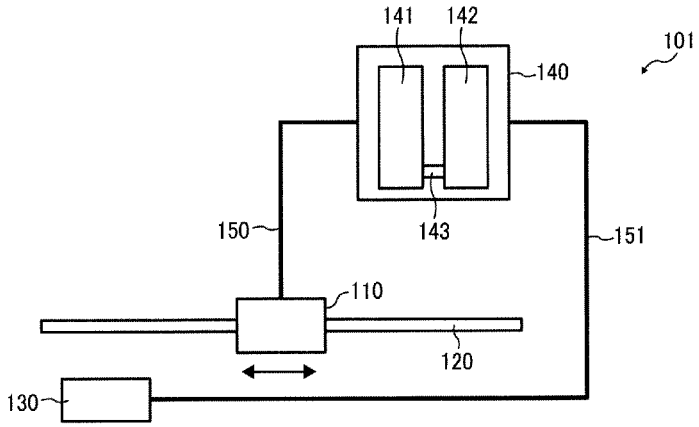
FIGS. 1A, 1B, and 1C are diagrams collectively illustrating an image forming apparatus that uses an ink cartridge according to one embodiment of the present invention.

Referring now to the drawings, wherein like reference numerals designate identical or corresponding parts throughout the several views thereof and in particular to FIG. 1A, an inkjet printer as an image forming apparatus using an ink cartridge is conceptually described. As shown there, the ink jet printer 101 has a printing head 110, a cleaning mechanism 130 and an ink cartridge 140.

The printing head 110 is movably supported by a carriage shaft 120 that extends in a widthwise direction of a given sheet conveyance route (i.e., a left and right direction in the drawing). The printing head 110 receives power from a driving motor, not shown, via a gear or the like to be able to move along the carriage shaft 120. The cleaning mechanism 130 is disposed outside the sheet conveyance path. The ink cartridge 140 accommodates an ink supply bag 141 and the waste ink collection bag. The ink supply bag 141 and the waste ink collection bag 142 are connected by a later-described connecting member 143.

When an image is formed, a recording sheet is transported in a direction orthogonal to the plane of the sheet of paper on which the drawing is drawn while the printing head 10 moves as described above. Subsequently, ink is supplied from the ink supply bag 141 in the ink cartridge 140 to the printing head 110 through a first liquid guiding channel 150. The printing head 110 then executes image recording by ejecting the ink from a nozzle or nozzles onto a surface of the printing sheet.

When the printing head 120 moves up to a position opposed to the cleaning mechanism 130, the cleaning mechanism 130 vacuums the ink leaking from the nozzle of the printing head 110 to remove the ink therefrom. The thus vacuumed and removed ink is sent through a second liquid guiding channel 151 and collected into the waste ink collection bag 142 included in the ink cartridge 140 as the ink waste. A back flow of the ink through the first and second liquid guiding channels 150 and 151 is created by a pump, not shown. Ink used in the image formation is initially filled into the ink supply bag 141 and is consumed as the image formation proceeds.

The waste ink collection bag 142 is empty at an initial stage. However, as the image formation process proceeds, the waste ink collection bag 142 is gradually filled with collected ink waste.

Figure 1B:
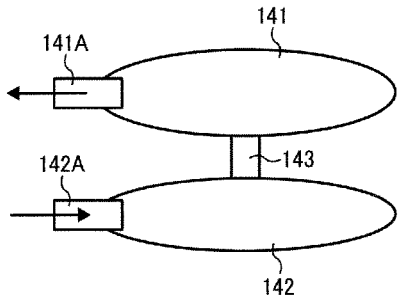

FIG. 1B conceptually illustrates the ink supply bag 141 and the waste ink collection bag 142 each housed inside the ink cartridge 140, and the connecting member 143 that connects these bags 141 and 142 with each other as well. The ink supply bag 142 is a deformable and includes an ink supply port 141A therein. The waste ink collection bag 142 is also a deformable and includes a liquid gateway 142A. The ink supply bag 141 and waste ink collection bag 142 have known structures made of known materials. For example, each of these ink supply bag 141 and waste ink collection bag 142 can be configured as a three-layer structure, such as a lamination of polyethylene, aluminum, and polyester, that of polyethylene, aluminum, and nylon, etc. Otherwise, these ink supply bag 141 and waste ink collection bag can be configured by such a three-layer structure, such as a lamination of polyethylene, aluminum, and cellophane; that of polyethylene, aluminum, and polypropylene, etc. The ink stored in the ink supply bag 141 is supplied from the ink supply port 141A to the printing head 110 through the aforementioned first liquid guiding channel 150. Further, the ink waste is sent to the waste ink collection bag 14 through the second liquid guiding channel 151 from the liquid gateway 142A.

Figure 1C:
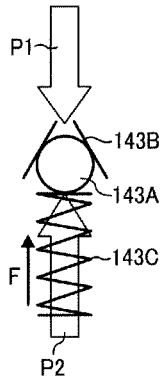

FIG. 1C conceptually represents a non-return valve provided in the connecting member 143 as described later more in detail. An upper side in FIG. 1C corresponds to a side of the ink supply bag 141 and a bottom side therein corresponds to a side of the waste ink collection bag 142. The non-return valve is conceptually composed of a movable spherical valve 143A, a stopper 143B, and a pressure member 143C. In the present embodiment, the pressure member 143C is a compression spring that presses the movable valve 141A against the stopper 143B with its elastic compression power. As shown there, the stopper 143B is opened on a side of the ink supply bag 141.

Thus, the below described three forces usually operate on the movable valve 143A. Specifically, a first force is a pressure P1 operating from the ink supply bag 141 through the opening side of the stopper 143B. A second force is a compression elastic force F caused by the pressure member 143C.

A third force is a pressure P2 caused by the waste ink collection bag 142.

Accordingly, the non-return valve is opened when a magnitude correlation among these three forces satisfies the following first inequality;

$$P1>P2+F \quad (1).$$

Whereas, the non-return valve does not open when the magnitude correlation among these three forces satisfies the following second inequality;

$$P1\leq P2+F \quad (2).$$

Accordingly, even though the ink waste is accumulated in the waste ink collection bag 142 and the pressure P2 thereof increases therein, the ink waste does not flow into the ink supply bag 141 as long as the relation of the second inequality is met.

Whereas, when the ink pressure P1 satisfies the first inequality, the ink stored in the ink supply bag 141 flows into the waste ink collection bag 142. However, the ink waste stored in the waste ink collection bag 142 does not flow into the ink supply bag 141.

Thus, even though there is ink present inside the ink supply bag 141 and the waste ink collection bag 142, the ink waste in the waste ink collection bag 142 neither flows into nor contaminates the ink supply bag 141.

Further, when the ink is supplied to the printing head, since the ink stored in the ink supply bag 141 is vacuumed, a negative pressure occurs in the ink supply bag 141.

However, because the relation of the second inequality is established, the ink waste stored in the waste ink collection bag 142 neither flows into nor contaminates the ink supply bag 141 once again.

Figure 2A:
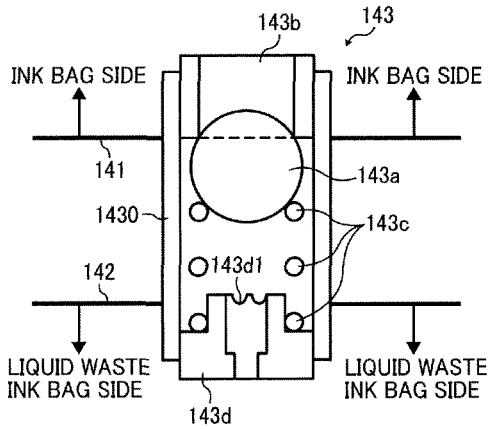
FIGS. 2A and 2B are diagrams collectively illustrating an aspect of connecting member when an inkjet printer executes printing according to another embodiment of the present invention.
Figure 2B:
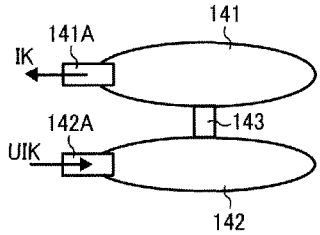

Now, with reference to FIGS. 2A and 2B, a specific aspect of the connecting member 143 is described more in detail. Specifically, FIG. 2A illustrates a condition when the non-return valve of the connecting member 143 is closed. As shown there, a reference number 1430 denotes a first hollow cylinder. The first hollow cylinder 1430 is made of metal, such as aluminum, etc., plastic, or the like. The first hollow cylinder 1430 penetrates the ink supply bag 141 and the waste ink collection bag 142 at its both ends to be secured thereto, respectively.

Further, a reference number 143*b* denotes a second hollow cylinder. The second hollow cylinder 143*b* is again made of metal, such as aluminum, etc., or plastic, or the like, and fits into an inner circumference of the first hollow cylinder 1430.

Further, a reference number 143A indicates a spherical movable valve. A reference number 143*c* indicates a compression spring. A reference number 143*d* indicates a third hollow cylinder having a step at its one end.

The third hollow cylinder 143*d* with the step is also made of metal, such as aluminum, etc., or plastic, or the like, and fits into another inner circumference of the first hollow cylinder 1430.

As illustrated in the drawing, the second hollow cylinder 143*b* is disposed on the side of the ink supply bag 141, whereas the third hollow cylinder 143*d* is provided on the side of the waste ink collection bag 142.

Thus, the movable valve 143*a* and the spring 143*c* are located between the hollow cylinders 143*b* and 143*d*. As one example, the movable valve 143*a* is located on the side of the hollow cylinder 143*b*. The spring 143 contacts an outside step of the hollow cylinder 143*d* and the movable valve 143*a* at its both ends, respectively, and is thus compressed.

The second hollow cylinder 143*b* thus serves as the above-described stopper.

In a condition shown in FIG. 2A, elastic force (i.e., the above-described force F) of the spring 143*c* operates on it and presses the movable valve 143*a* against the hollow cylinder 143*b* (i.e., the stopper) to put the non-return valve in the closed state.

Accordingly, when it is supposed that pressure in the waste ink collection bag 142 is P0 and that in the ink supply bag 141 is P when neither supplying ink nor collection of ink waste is carried out, these pressures P and P0 meet the below described third inequality;

$$P<P0+F \quad (3).$$

Thus, the non-return valve remains in the closed state, so that the ink stored in the ink supply bag 141 does not flow into to the waste ink collection bag 142.

In such a system, when ink IK is to be supplied and ink waste UIK is to be collected, the ink IK is vacuumed from the ink supply bag 141 and the ink waste UIK is collected into the waste ink collection bag 142 as shown in FIG. 2B.

However, when it is supposed that pressure in the waste ink collection bag 142 is P2 and that in the ink supply bag 141 is P1, inequalities P1<P and P2>P0 are obviously established and accordingly, the above-described second inequality can be met.

Thus, the ink waste stored in the waste ink collection bag 142 does not flow into to the ink supply bag 141 even when the inkjet printer executes printing.

Figure 3A:
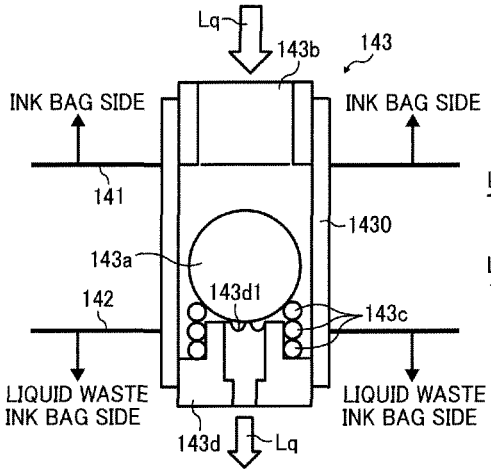
FIGS. 3A and 3B are diagrams collectively illustrating an aspect of a connecting member when the ink supply bag and the waste ink collection bag are cleaned according to yet another embodiment of the present invention.
Figure 3B:
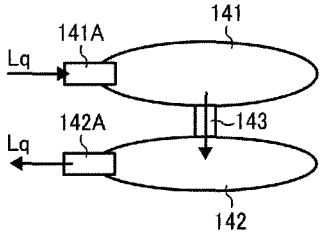

FIGS. 3A and 3B collectively illustrate an aspect when the ink supply bag 141 and the waste ink collection bag 142 are cleaned (i.e., washed). To execute cleaning, ink waste stored in the waste ink collection bag 142 is initially vacuumed and discharged therefrom.

At this moment, the waste ink collection bag 142 is in a large negative pressure state, and accordingly the non-reversing valve is opened, so that residual ink remaining in the ink supply bag 141 is discharged outside through the waste ink collection bag 142.

Hence, once the ink supply bag 141 and the waste ink collection bag 142 are emptied, cleaning liquid Lq is pumped thereinto from a liquid supply port 141A as shown in FIG. 3B.

At this moment, the waste ink collection bag 142 is also vacuumed and enters a negative pressure condition inside thereof.

The ink supply bag 141 is filled with and cleaned by the cleaning liquid Lq pumped thereinto through the liquid supply port 141A thereby increasing internal pressure P1 thereof at the same time.

When the inner pressure P1 satisfies the first inequality (1), the non-return valve is opened as shown in FIG. 3A and the cleaning liquid Lq flows into the waste ink collection bag 142 through the connecting member 143.

The thus entered cleaning liquid Lq then cleans the waste ink collection bag 142 while flowing through inside thereof. The cleaning liquid Lq is subsequently discharged from a gateway 142*a* and is collected finally.

Further, multiple grooves 143*d*1 are provided on an upper end of the third hollow cylinder 143*d* facing the movable valve 143*a*.

Accordingly, even though the movable valve 143*a* contacts the top of the third hollow cylinder 143*d*, the cleaning liquid Lq flows toward the waste ink collection bag 142 through the multiple grooves 143*d*1.

In this way, according to one embodiment of the present invention, the ink supply bag 141 and the waste ink collection bag 142 can be cleaned without separating those from each other in the ink cartridge.

Specifically, the ink supply bag 141 and the waste ink collection bag 142 can be cleaned with those being installed in the ink cartridge.

Further, when an ink supply bag 141 and a waste ink collection bag 142 are newly manufactured or used bags 141 and 142 are reused for recycling, these bags 141 and 142 are empty, initially.

In such a situation, when ink IK is injected into the ink supply bag 141, the waste ink collection bag 142 is empty and accordingly pressure therein is zero.

Whereas, as ink injection into the ink supply bag 141 progresses, the pressure therein rises and the above-described first inequality is satisfied, and accordingly, the ink flows from the ink supply bag 141 into the waste ink collection bag 142 as a problem.

To avoid such a problem, a non-return valve control mechanism is preferably provided to generally control operation of the non-return valve and inhibit the non-return valve to operate when the ink is initially filled as described above.

Further, the non-return valve control mechanism is also preferably operated after collection of the ink waste into the waste ink collection bag 142 is started.

Figure 4A:
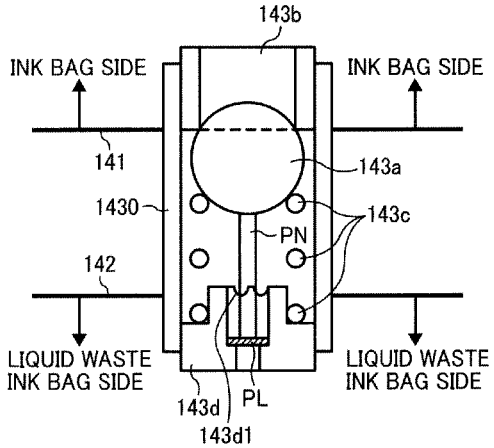
FIGS. 4A and 4B are diagrams collectively illustrating an aspect when the ink supply bag is initially filled with ink according to yet another embodiment of the present invention.

Now, such an exemplary non-return valve control mechanism is described with reference to FIGS. 4A and 4B. Specifically, in FIG. 4A, a reference sign PN denotes a supporting pin. A reference sign PL denotes a pressing plate. FIG. 4A also illustrates an aspect when the ink supply bag 141 is initially filled with ink IK.

The pressing plate PL and the supporting pin PN are arranged to collectively constitute the non-return valve control mechanism as shown in a drawing. The pressing plate PL is usually made of hard material softened when it absorbs ink.

The pressing plate PL is disposed on a level difference formed on the inner circumference of the third hollow cylinder 143*d* and seals a hole of the third hollow cylinder 143*d*. Whereas, by placing the supporting pin PN between the pressing plates PL and the movable valve 143 *a*, an interval therebetween is kept.

Figure 4B:
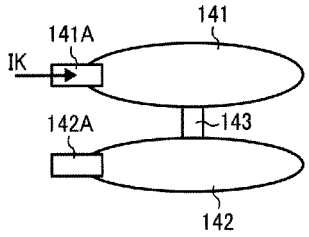

FIG. 4B illustrates an aspect when the ink supply bag 141 is initially filled with the ink IK through the ink supply port 141A.

Here, when the ink supply bag 141 is initially filled with the ink IK, since the ink waste is not accumulated in the waste ink collection bag 142, pressure in the waste ink collection bag 142 is zero.

Subsequently, as filling of the ink IK into it progresses, the pressure in the ink supply bag 141 rises. However, the non-return valve does not operate, because the pressing plate PL and the supporting pin PN cooperatively support the movable valve 143*a*.

Thus, the ink supply bag 41 can be successfully filled with the ink IK.

Figure 5A:
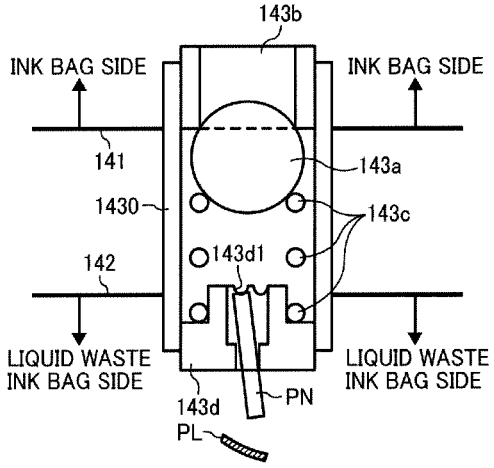
FIGS. 5A and 5B are diagrams collectively illustrating collection of ink waste into the waste ink collection bag according to yet another embodiment of the present invention.
Figure 5B:
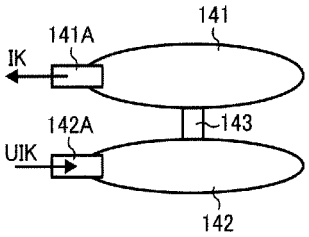

Further, FIGS. 5A and 5B collectively illustrate an aspect when the ink waste is collected.

When printing starts, the ink IK is vacuumed while collection of the ink waste UIK into the waste ink collection bag 142 is started as shown in FIG. 5B. The thus collected ink waste UIK contacts the pressing plate PL passing through an opening of the third hollow cylinder 143*d*. The pressing plate PL absorbs the ink waste and is softened thereby deforming due to pressure given by the supporting pin PN. Accordingly, the pressing plate PL is pushed out into the waste ink collection bag 142 as shown in FIG. 5A. At the same time, the supporting pin PN also separates from the connecting member and enters the waste ink collection bag 142. Hence, the non-return valve becomes an operable state.

Hence, with the above-described configuration, when the ink supply bag 141 is initially filled with ink, the non-return valve is not activated and a section between the ink supply bag 141 and the waste ink collection bag 142 is sealed, so that the ink is not flown therebetween.

Thus, ink initial filling functionality to the ink supply bag 141 can be preferably maintained.

Further, the non-return valve becomes operable when the ink cartridge is attached to the image forming apparatus and the ink waste UIK is collected into the waste ink collection bag 142.

At this moment, since the ink is supplied from the ink supply bag 141 to the printing head, pressure in the ink supply bag 141 is either less than the pressure in the waste ink collection bag 142 or the same level with it at most.

Thus, the non-return valve also is not opened and the section between the ink supply bag 141 and the waste ink collection bag 142 is tightly sealed, so that the ink waste UIK does not flow into the ink supply bag 141. Specifically, an ink accommodation function of each of the ink supply bag 141 and the waste ink collection bag 142 is separately maintained while avoiding the ink waste from being mixed into the ink in the ink supply bag 141.

Further, in the above-described examples, since the supporting pin PN and the pressing plate PL are disposed inside the connecting member, the connecting member is preferably configured to enable detachment of the non-return valve from at least one of the waste ink collection bag and the ink supply bag.

With this, when the waste ink collection bag and the ink supply bag and cleaned and are reused, the pressing plate PL and the supporting pin PN collectively constituting the non-return valve control mechanism can be easily installed within the non-return valve.

Now, three exemplary modifications having the above-described configuration are described with reference to FIGS. 6A to 6D, wherein, the same reference signs are affixed to devices as in FIGS. 2A to 5B for the sake of simplicity.

Figure 6A:
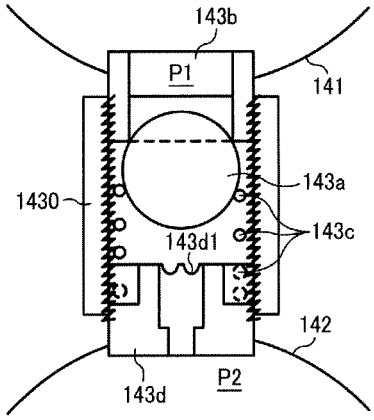
FIGS. 6A to 6D are diagrams collectively illustrating three examples of the implementation of the connecting member according to yet another embodiment of the present invention.

The same reference signs are also affixed to devices in FIG. 7A and following drawings as in FIGS. 2A to 5B for the sake of simplicity. As shown in FIG. 6A, as a modification, the second hollow cylinder 143*b* is fixed to the ink supply bag 141 while the third hollow cylinder 143*d* having the difference in level is secured to the waste ink collection bag 142. Further, a screw groove is formed on an outer perimeter of each of these hollow cylinders 143*d* and 143*b* and an inner perimeter of the first hollow cylinder 1430 as well. These hollow cylinders 143*b* and 143*d* are then fastened to be detachably attached from and to each other using the first hollow cylinder 1430 based on such a screw construction.

Figure 6B:
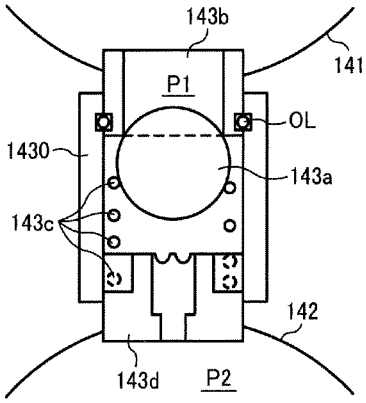

Further, in another modification of FIG. 6B, grooves are formed on the inner circumference of the first hollow cylinder 1430 and the outer circumference of the hollow cylinder 143*b*, respectively. Then, an elastic O-ring OL is attached as a gasket between the grooves of the inner circumference and the outer circumference. Hence, these hollow cylinders 1430 and 143*b* can be detachably attached.

Figure 6C:
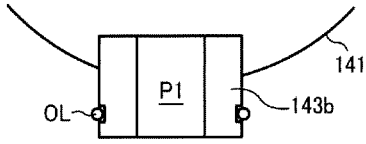

FIG. 6C illustrates an aspect when the second hollow cylinder 143*b* is provided with another O-ring OL.

Figure 6D:
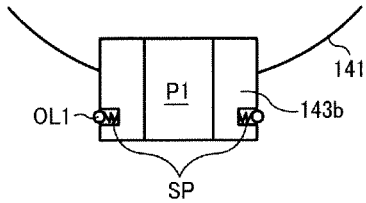

FIG. 6D is a further modification of the modifications of FIGS. 6B and 6C.

Specifically, a compression spring SP is provided between the bottom of the groove of the second hollow cylinder 143 band the O-ring OL, so that engagement of the second hollow cylinder 143 band the O-ring OL can be strengthened.

In any one of these modifications, the pressing plate PL and the supporting pin PN can be easily re-installed when the ink supply bag and the waste ink collection bag are reused. Also, it is noted that P1 and P2 indicated in FIGS. 6A to 6D represent pressure as described earlier.

Hence, in the above described embodiments, the ink supply bag 141 and the waste ink collection bag 142 are independently installed in the ink cartridge from each other. However, one of the ink supply bag 141 and the waste ink collection bag 142 can be included in the other one of them.

Figure 7:
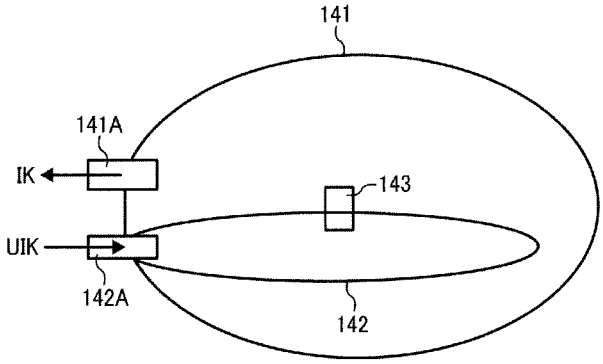
FIG. 7 is a diagram illustrating an ink cartridge according to yet another embodiment of the present invention.

For example, as shown in FIG. 7, the waste ink collection bag 142 is provided inside the ink supply bag 141 connecting these ink supply bags with the connecting member 143.

By contrast, the waste ink collection bag 142 can be provided outside the ink supply bag 141.

In such a situation, a magnitude correlation between the ink supply bag 141 and the waste ink collection bag 142 becomes opposite to that in FIG. 7, and the ink supply bag 141 is installed in the waste ink collection bag 142, accordingly.

Figure 8:
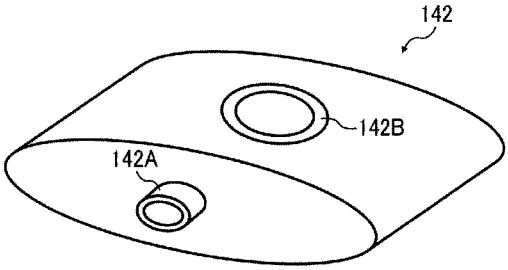
FIG. 8 is a diagram illustrating an ink cartridge according to yet another embodiment of the present invention.

When the waste ink collection bag 142 is located outside the ink supply bag 141 or the ink supply bag 141 is embraced in the waste ink collection bag 141, the waste ink collection bag 142 can be designed as shown in FIG. 8. Specifically, a gas-liquid separation member 142B is provided in the waste ink collection bag 142 to prohibit liquid, such as ink, ink waste, cleaning liquid, etc., from penetrating thereof.

Specifically, with the gas-liquid separation member 142B air in the waste ink collection bag 142 may be evacuated through the gas-liquid separation member 142B without employing an atmospheric opening needle or the like.

Hence, even in a low pressure environment, air in the waste ink collection bag 142 neither inflate nor causes the ink waste to leak from a rubber seal provided in the waste ink collection bag 142.

Further, because the air is not accumulated in the waste ink collection bag 142, the waste ink can be collected into the waste ink collection bag 142 even having the minimum size until the ink stored in the ink supply bag 141 is used up.

Figure 9:
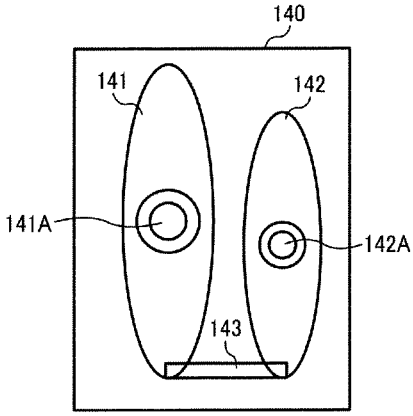
FIG. 9 is a diagram illustrating an ink cartridge according to yet another embodiment of the present invention.

The waste ink collection bag and the ink supply bag each generally has an elliptic cylindrical shape as shown FIG. 8, and is frequently utilized with a longer axis of an ellipsis of each cross section directing to a vertical direction. In such a situation, the connecting member 143 is preferably arranged at a prescribed position to connect the ink supply bag 141 and the waste ink collection bag 142 with each other through the non-return valve as shown in FIG. 9. Specifically, the connecting member 143 is almost disposed at respective bottoms of the ink supply bag 141 and the waste ink collection bag 142, specifically at their lower sections in the drawing. With this, when the non-return valve control mechanism constituted by the supporting pin PN and the pressing plate PL is employed, the collected ink waste contacts the pressing plate PL relatively shortly. Accordingly, the non-return valve can operate relatively in an early stage.

As described heretofore, according to one aspect of the present invention, since a waste ink collection bag and an ink supply bag are installed in a common housing of an ink cartridge, a remaining space can be effectively utilized with a downsized ink cartridge. Further, since the waste ink collection bag can be replaced together with the ink cartridge, and accordingly, conventionally needed replacement of an ink waste unit is omitted, a user interface can be friendly. That is, a novel ink cartridge includes a deformable ink supply bag having an ink supply port, a deformable waste ink collection bag having a fluid gateway, and a cartridge housing to accommodate the deformable ink supply bag and the deformable waste ink collection bag together.

According to another aspect of the present invention, since the ink supply bag and the waste ink collection bag are connected using a connecting member having a non-return valve, the ink supply bag and waste ink collection bag can be washed in a recycling process without separating these bags from each other. That is, a connecting member has a non-return valve and is provided to connect the deformable ink supply bag and the deformable waste ink collection bag with each other at a section other than the ink supply port and the fluid gateway.

According to yet another aspect of the present invention, a non-return valve control mechanism is provided to control operation of the non-return valve of the connecting member. The non-return valve control mechanism does not operate the non-return valve when the ink supply bag is initially filled with ink.

According to yet another aspect of the present invention, a non-return valve control mechanism is provided to control operation of the non-return valve of the connecting member.

The non-return valve control mechanism operates the non-return valve when the waste ink collection bag starts collecting ink waste.

According to yet another aspect of the present invention, the non-return valve control mechanism operates the non-return valve to flow the ink from the ink supply bag to the waste ink collection bag when pressure of the ink supply bag is higher than that of the waste ink collection bag.

According to yet another aspect of the present invention, the connecting member includes a pressing plate transformable when contacted by ink, and a supporting pin to support the pressing plate closing an opening formed in the non-return valve on a side of the waste ink collection bag. The pressing plate leaves from the connecting member together with the supporting pin when the ink waste contacts the pressing plate.

According to yet another aspect of the present invention, the connecting member is disposed at respective bottoms of the ink supply bag and the waste ink collection bag.

According to yet another aspect of the present invention, the waste ink collection bag includes a gas-liquid separation member to prevent penetration of the ink.

According to yet another aspect of the present invention, the non-return valve is detachable from one of the waste ink collection bag and the ink supply bag.

According to yet another aspect of the present invention, the ink supply bag is installed in the waste ink collection bag.

According to yet another aspect of the present invention, with an image forming apparatus that employs the ink cartridge, replacement of the ink cartridge and recycling of both the ink supply bag and the waste ink collection bag can be easier. This is because, an ink cartridge provided in the image forming apparatus according to one embodiment of the present invention includes a deformable ink supply bag having an ink supply port, a deformable waste ink collection bag having a fluid gateway, a cartridge housing to accommodate the deformable ink supply bag and the deformable waste ink collection bag together, and a connecting member having a non-return valve to connect the deformable ink supply bag and the deformable waste ink collection bag with each other at a section other than the ink supply port and the fluid gateway.

Numerous additional modifications and variations of the present invention are possible in light of the above teachings. It is therefore to be understood that within the scope of the appended claims, the present invention may be executed otherwise than as specifically described herein.

What is claimed is:

1. An ink cartridge comprising:

a deformable ink supply bag having an ink supply port;

a deformable waste ink collection bag having a fluid gateway;

a cartridge housing to accommodate the deformable ink supply bag and the deformable waste ink collection bag together; and a connecting member having a non-return valve to connect the deformable ink supply bag and the deformable waste ink collection bag with each other at a section other than the ink supply port and the fluid gateway, wherein the non-return valve prevents ink from flowing from the waste ink collection bag into the ink supply bag, wherein the connecting member comprises:

a pressing plate that deforms when contacted by ink; and a supporting pin to support the pressing plate closing an opening formed in the non-return valve on a side of the waste ink collection bag, and wherein the pressing plate that deforms and separates from the connecting member together with the supporting pin when the ink waste contacts the pressing plate.

2. The ink cartridge as claimed in claim 1, further comprising a non-return valve control mechanism to control operation of the non-return valve of the connecting member, wherein the non-return valve control mechanism does not operate the non-return valve in an initial state in which the ink supply bag is initially filled with ink.

3. The ink cartridge as claimed in claim 1, further comprising a non-return valve control mechanism to control operation of the non-return valve of the connecting member, wherein the non-return valve control mechanism operates the non-return valve when the waste ink collection bag starts collecting ink waste.

4. The ink cartridge as claimed in claim 3, wherein the non-return valve control mechanism operates the non-return valve to flow the ink from the ink supply bag to the waste ink collection bag when pressure in the ink supply hag is higher than that in the waste ink collection bag.

5. The ink cartridge as claimed in claim 1, wherein the connecting member is disposed at respective bottoms of the ink supply bag and the waste ink collection bag.

6. The ink cartridge as claimed in claim 1, wherein the waste ink collection bag includes a gas-liquid separation member to prevent penetration of the ink.

7. The ink cartridge as claimed in claim 1, wherein the non-return valve is detachable from at least one of the waste ink collection bag and the ink supply bag.

8. The ink cartridge as claimed in claim 1, wherein the ink supply bag is installed in the waste ink collection bag.

9. An image forming apparatus comprising:

an image forming device to form an image; and an ink cartridge including:

a deformable ink supply bag having an ink supply port;

a deformable waste ink collection bag having a fluid gateway;

a cartridge housing to accommodate the deformable ink supply bag and the deformable waste ink collection bag together; and a connecting member having a non-return valve to connect the deformable ink supply bag and the deformable waste ink collection bag with each other at a section other than the ink supply port and the fluid gateway, wherein the non-return valve prevents ink from flowing from the waste ink collection bag into the ink supply bag, wherein the connecting member comprises:

a pressing plate that deforms when contacted by ink; and a supporting pin to support the pressing plate closing an opening formed in the non-return valve on a side of the waste ink collection bag, wherein the pressing plate that deforms and separates from the connecting member together with the supporting pin when the ink waste contacts the pressing plate.

10. The image forming apparatus as claimed in claim 9, further comprising a non-return valve control mechanism to control operation of the non-return valve of the connecting member, wherein the non-return valve control mechanism does not operate the non-return valve in an initial state in which the ink supply bag is initially filled with ink.

11. The image forming apparatus as claimed in claim 9, further comprising a non-return valve control mechanism to control operation of the non-return valve of the connecting member, wherein the non-return valve control mechanism operates the non-return valve when the waste ink collection bag starts collecting ink waste.

12. The image forming apparatus as claimed in claim 11, wherein the non-return valve control mechanism operates the non-return valve to flow the ink from the ink supply bag to the waste ink collection bag when pressure in the ink supply bag is higher than that in the waste ink collection bag.

13. The image forming apparatus as claimed in claim 9, wherein the connecting member is disposed at respective bottoms of the ink supply bag and the waste ink collection bag.

14. The image forming apparatus as claimed in claim 9, wherein the waste ink collection bag includes a gas-liquid separation member to prevent penetration of the ink.

15. The image forming apparatus as claimed in claim 9, wherein the non-return valve is detachable from at least one of the waste ink collection bag and the ink supply bag.

16. The image forming apparatus as claimed in claim 9, wherein the ink supply bag is installed in the waste ink collection bag.

* * * * *